US011266895B2

(12) United States Patent
Wang et al.

(10) Patent No.: US 11,266,895 B2
(45) Date of Patent: Mar. 8, 2022

(54) DEVICE FOR MEASURING SPEED OF TENNIS BALL

(71) Applicant: Wuyi University, Jiangmen (CN)

(72) Inventors: Tianlei Wang, Jiangmen (CN); Na Xiao, Jiangmen (CN); Yijia Deng, Jiangmen (CN); Junjie Xu, Jiangmen (CN); Zijian Li, Jiangmen (CN); Jingling Zhang, Jiangmen (CN); Yikui Zhai, Jiangmen (CN); Jiangyuan Chen, Jiangmen (CN); Chaojian Xie, Jiangmen (CN); Yiren Long, Jiangmen (CN)

(73) Assignee: Wuyi University, Jiangmen (CN)

( * ) Notice: Subject to any disclaimer, the term of this patent is extended or adjusted under 35 U.S.C. 154(b) by 113 days.

(21) Appl. No.: 16/937,222

(22) Filed: Jul. 23, 2020

(65) Prior Publication Data

US 2021/0008431 A1 Jan. 14, 2021

(30) Foreign Application Priority Data

Jun. 4, 2019 (CN) ..... 201910480874.4

(51) Int. Cl.
*A63B 69/40* (2006.01)
*A63B 69/38* (2006.01)

(52) U.S. Cl.
CPC ..... *A63B 69/40* (2013.01); *A63B 69/38* (2013.01); *A63B 2220/36* (2013.01)

(58) Field of Classification Search
CPC ..... A63B 24/00; A63B 6/00; A63B 69/36; A63B 69/40; A63F 9/24
See application file for complete search history.

(56) References Cited

U.S. PATENT DOCUMENTS 5,486,002 A * 1/1996 Witler ..... A63B 69/3658 473/199
5,566,934 A * 10/1996 Black ..... A63B 24/0021 124/7
5,602,638 A * 2/1997 Boulware ..... A63B 24/0021 356/28
5,984,810 A * 11/1999 Frye ..... A63B 24/0021 473/422
2001/0056000 A1* 12/2001 Hori ..... A63B 69/002 473/453
2008/0201100 A1* 8/2008 Petrov ..... G01S 5/16 702/149

(Continued)

*Primary Examiner* — Alvin A Hunter
*Assistant Examiner* — Christopher Glenn
(74) *Attorney, Agent, or Firm* — Vivacqua Crane PLLC

(57) ABSTRACT

Disclosed is a device for measuring speed of a tennis ball, which includes: a housing, a power supply, a main control device, a sensor device, a transmission device, a clamping device and a limiting device. The clamping device is clamped at the serve opening of a tennis ball machine, which can detect the serve speed of a tennis ball accurately with simple operation. The transmission device is engaged with the second sensor device, and the housing is slidably connected with the second sensor device. The emitting ends of the second sensor device and the first sensor device are positioned in the same vertical plane. The limiting device is connected with the second sensor device to limit excessive operation of the transmission device.

9 Claims, 4 Drawing Sheets

(56) References Cited

U.S. PATENT DOCUMENTS

| | | | | |
|---|---|---|---|---|
| 2008/0207347 | A1* | 8/2008 | Rose | A63B 69/3676 473/222 |
| 2009/0298622 | A1* | 12/2009 | Roberts | A63B 24/00 473/455 |
| 2010/0004075 | A1* | 1/2010 | Maeda | A63B 24/0021 473/436 |
| 2011/0281621 | A1* | 11/2011 | Murdock | A63F 13/814 463/3 |
| 2013/0218308 | A1* | 8/2013 | Altshuler | G16Z 99/00 700/91 |
| 2015/0258402 | A1* | 9/2015 | Bynum | H04M 1/725 473/453 |
| 2015/0306455 | A1* | 10/2015 | DeCarlo | A63B 63/00 473/422 |

* cited by examiner

DEVICE FOR MEASURING SPEED OF TENNIS BALL

CROSS-REFERENCE TO RELATED APPLICATIONS

This application is based on and claims the benefit of priority from Chinese Patent Application No. 2019104808744, filed on 4 Jun. 2019, the entirety of which is incorporated by reference herein.

TECHNICAL FIELD

The present disclosure relates to the technical field of speed measuring devices, in particular to a device for measuring speed of a tennis ball.

BACKGROUND

Currently, tennis is generally played in a one-on-one or two-on-two manner. In order to meet the needs of tennis training for a single player, tennis ball machines have appeared on the market to provide the function of playing tennis by a single player. However, the existing tennis ball machines do not have the function of measuring speed of a tennis ball, so a tennis player cannot judge whether the speed of the tennis ball reaches the criteria. Moreover, the existing devices for measuring speed of a tennis ball can only measure the speed of a tennis ball at a certain moment during the movement thereof after leaving a tennis ball machine, and cannot accurately display the serve speed of the tennis ball, nor can it bring more professional training to the tennis player. Meanwhile, the existing devices for measuring speed of a tennis ball are relatively bulky and inconvenient for moving and carrying.

SUMMARY

To solve the above problems, the disclosure is intended to provide a device for measuring speed of a tennis ball that can be fixed to the serve opening of a tennis ball machine, which is convenient for measuring the serve speed accurately and brings more professional training for a tennis player. Moreover, the device for measuring speed of a tennis ball has a telescopic function, which is convenient for moving and carrying.

The technical solutions adopted by the disclosure to solve the problems thereof are as follows.

The disclosure provides a device for measuring speed of a tennis ball, including: a housing, a power supply, a main control device, a sensor device, a transmission device, a clamping device and a limiting device for limiting excessive operation of the transmission device. The sensor device includes a first sensor device and a second sensor device. The transmission device is engaged with the second sensor device to drive the second sensor device so that an emitting end of the second sensor device and an emitting end of the first sensor device are in a same vertical plane. The limiting device is connected to the second sensor device to limit excessive operation of the transmission device. The housing is connected respectively to the power supply, the main control device, the first sensor device, the transmission device, the limiting device and the clamping device, and is slidably connected with the second sensor device. The power supply is connected to the main control device, the first sensor device, the second sensor device, the transmission device and the limiting device. The main control device is connected respectively to the first sensor device, the second sensor device, the transmission device and the limiting device.

Further, the first sensor device includes: a first fixing plate and a plurality of first inductive sensors vertically arranged on the first fixing plate, the second sensor device includes: a second fixing plate and a plurality of second inductive sensors vertically arranged on the second fixing plate, and emitting ends of the plurality of first inductive sensors and emitting ends of plurality of second inductive sensors are in a same vertical plane. The power supply is connected respectively with the first inductive sensors and the second inductive sensors, the main control device is connected respectively with the first inductive sensors and the second inductive sensors, and the second fixing plate is connected respectively with the transmission device and the limiting device, the second fixing plate is slidably connected with the housing and is engaged with the transmission device.

Further, the housing is provided with a first vertical guide groove and a second vertical guide groove for guiding the second fixing plate to slide vertically.

Further, the transmission device includes a motor, a transmission shaft, a gear, and a knob for controlling operation of the motor. The transmission shaft has a lower end connected to the motor and an upper end connected to the gear. The gear is engaged with a vertical side of the second fixing plate, the motor is connected respectively to the main control device and the power supply, the knob is connected to the main control device and provided on a surface of the housing.

Further, the second fixing plate is provided with a limiting block, and the second vertical guide groove is provided with a first elongated slot, to which the limiting block is slidably connected, for limiting a sliding distance of the limiting block.

Further, the limiting device includes a first limiting switch at a top end of the first elongated slot and a second limiting switch at a bottom end of the first elongated slot. The limiting block is connected to the first limiting switch or the second limiting switch to limit excessive operation of the transmission device.

Further, the clamping device includes: a lug, a torsion spring, a pin and a clip. The housing is connected to the lug, and the clip is hinged to the lug via the torsion spring and the pin.

Further, the second inductive sensor is infrared sensor or ultrasonic sensor.

Further, the housing is provided with a display screen on a surface of the housing, which is connected respectively with the power supply and the main control device.

The technical solutions provided according to the embodiments of the disclosure have at least the beneficial effects as follows.

The device for measuring speed of a tennis ball is fixed at a serve opening of a tennis ball machine by clamping of the clamping device at the serve opening of the tennis ball machine, which can detect the serve speed of a tennis ball accurately with simple operation. The transmission device is engaged with the second sensor device, and the housing is slidably connected with the second sensor device, so that the second sensor device has a telescopic function, which increases the detection range for tennis balls, reduces the volume of the device for measuring speed of a tennis ball so that it is convenient for moving and carrying. The emitting ends of the second sensor device and the first sensor device are positioned in the same vertical plane, so that a tennis ball can be detected by the first inductive sensor device and the second inductive sensor device in the same vertical plane, thereby reducing detection errors caused by position differences and improving accuracy of speed detection. The limiting device is connected with the second sensor device to limit excessive operation of the transmission device, thereby preventing the second sensor device from falling off and being damaged due to excessive movement of the second sensor device caused by the excessive operation of the transmission device.

BRIEF DESCRIPTION OF THE DRAWINGS

The disclosure will be further described below with reference to the drawings and examples.

DETAILED DESCRIPTION

The existing tennis ball machines do not have the function of measuring speed of a tennis ball, so a tennis player cannot judge whether the speed of the tennis ball reaches the criteria. Moreover, the existing devices for measuring speed of a tennis ball can only measure the speed of a tennis ball at a certain moment during the movement thereof after served by a tennis ball machine, and cannot accurately display the serve speed of the tennis ball, nor can it bring more professional training to the tennis player. Meanwhile, the existing devices for measuring speed of a tennis ball are relatively bulky and inconvenient for moving and carrying.

Based on this, the disclosure provides a device for measuring speed of a tennis ball that can be fixed to the serve opening of a tennis ball machine, which is convenient for measuring the serve speed accurately. Moreover, the device for measuring speed of a tennis ball has a telescopic function, which is convenient for moving and carrying.

The embodiments of the disclosure will be further described below with reference to the drawings.

Figure 1:
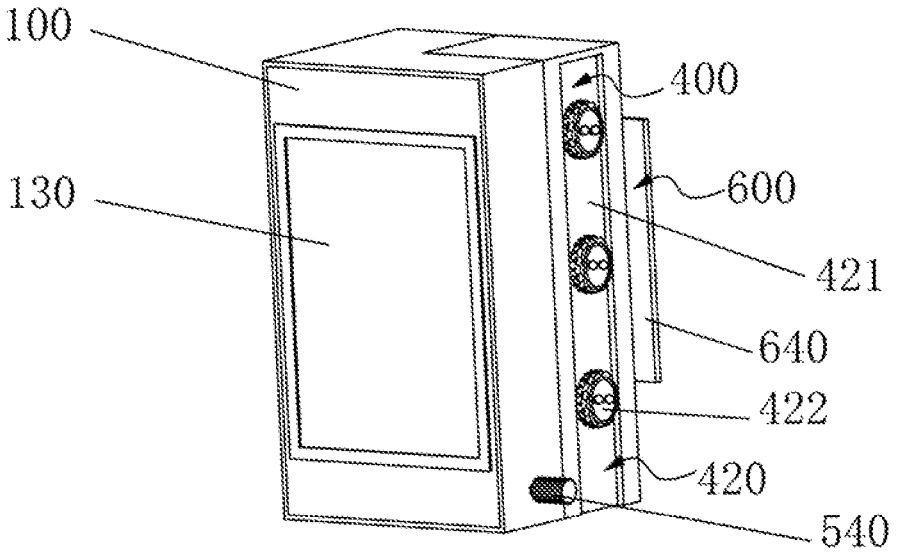
FIG. 1 is an overall structural view of a device for measuring speed of a tennis ball according to an embodiment of the disclosure.
Figure 3:
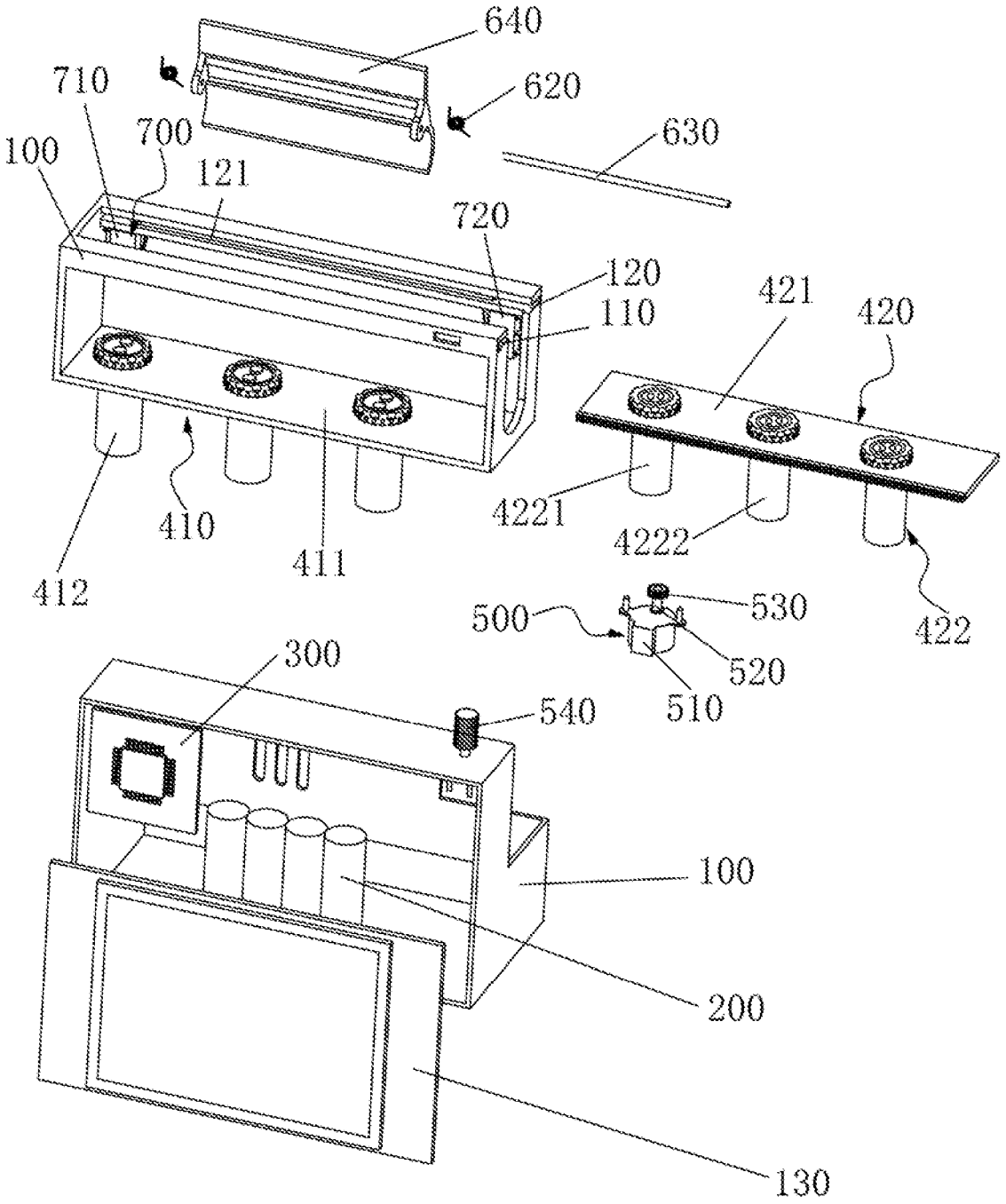
FIG. 3 is an exploded structural view of the device for measuring speed of a tennis ball according to an embodiment of the disclosure.

With reference to FIG. 1 and FIG. 3, a device for measuring speed of a tennis ball is provided according to an embodiment of the disclosure, including: a housing 100, a power supply 200, a main control device 300, a sensor device 400, a transmission device 500, a clamping device 600 and a limiting device 700 for limiting excessive operation of the transmission device 500. The sensor device 400 includes a first sensor device 410 and a second sensor device 420; the transmission device 500 is engaged with the second sensor device 420 to drive the second sensor device 420 so that an emitting end of the second sensor device 420 and an emitting end of the first sensor device 410 are in a same vertical plane; the limiting device 700 is connected to the second sensor device 420 to limit excessive operation of the transmission device 500. The housing 100 is connected respectively to the power supply 200, the main control device 300, the first sensor device 410, the transmission device 500, the limiting device 700 and the clamping device 600, and is slidably connected with the second sensor device 420. The power supply 200 is connected to the main control device 300, the first sensor device 410, the second sensor device 420, the transmission device 500 and the limiting device 700. The main control device 300 is connected respectively to the first sensor device 410, the second sensor device 420, the transmission device 500 and the limiting device 700.

In this embodiment, the device for measuring speed of a tennis ball is fixed at a serve opening of a tennis ball machine by clamping of the clamping device 600 at the serve opening of the tennis ball machine, which can detect the serve speed of a tennis ball accurately with simple operation. The transmission device 500 is engaged with the second sensor device 420, and the housing 100 is slidably connected with the second sensor device 420, so that the second sensor device 420 has a telescopic function, which increases the detection range for tennis balls, reduces the volume of the device for measuring speed of a tennis ball so that it is convenient for moving and carrying. The emitting ends of the second sensor device 420 and the first sensor device 410 are positioned in the same vertical plane, so that a tennis ball can be detected by the first inductive sensor 412 device 400 and the second inductive sensor 422 device 400 in the same vertical plane, thereby reducing detection errors caused by position differences and improving accuracy of speed detection. The limiting device 700 is connected with the second sensor device 420 to limit excessive operation of the transmission device 500, thereby preventing the second sensor device 420 from falling off and being damaged due to excessive movement of the second sensor device 420 caused by the excessive operation of the transmission device 500.

The power supply 200 is configured for supplying power to the main control device 300, the first sensor device 410, the second sensor device 420, the limiting device 700 and the transmission device 500. The main control device 300 is configured for measuring the serve speed of the tennis ball. The housing 100 is configured for accommodating and connecting the power supply 200, the main control device 300, the transmission device 500, the clamping device 600, the first sensor device 410, the second sensor device 420, and the limiting device 700. The shape of the housing 100 and the positions of the above components in the housing 100 or on the housing 100 are not limited, and preferably, the housing 100 may be configured as including two accommodating spaces, one of which is in a stepped form and is configured for accommodating the power supply 200 and the main control device 300, and the other of which is in a rectangular form and is configured for accommodating the first sensor device 410 and the second sensor device 420. The two spaces are fixedly connected with each other, with a positioning slot arranged at a connection thereof, and the first sensor device 410 and/or the second sensor device 420 are connected with the power supply 200 and the main control device 300 through the positioning slot. The clamping device 600 is arranged outside the housing 100, and is configured for clamping the serve opening of a tennis ball machine. The transmission device 500 and the limiting device 700 may be arranged in the housing 100 or on the housing 100.

A device for measuring speed of a tennis ball is further provided according to another embodiment of the disclosure, wherein the first sensor device 410 includes: a first fixing plate 411 and a plurality of first inductive sensors 412 vertically arranged on the first fixing plate 411, the second sensor device 420 includes: a second fixing plate 421 and a plurality of second inductive sensors 422 vertically arranged on the second fixing plate 421, and emitting ends of the plurality of first inductive sensors 412 and emitting ends of plurality of second inductive sensors 422 are in a same vertical plane. The power supply 200 is connected respectively with the first inductive sensors 412 and the second inductive sensors 422, the main control device 300 is connected respectively with the first inductive sensors 412 and the second inductive sensors 422, and the second fixing plate 421 is connected respectively with the transmission device 500 and the limiting device 700, the second fixing plate 421 is slidably connected with the housing 100 and is engaged with the transmission device 500.

In this embodiment, the second fixing plate 421 is slidably connected with the housing 100 and is engaged with the transmission device 500, so that the second fixing plate 421 has a telescopic function to bring the plurality of the second inductive sensors 422 to move, which increases the detection range for tennis balls, reduces the volume of the device for measuring speed of a tennis ball so that it is convenient for moving and carrying. The plurality of first inductive sensors 412 are arranged vertically on the first fixing plate 411, the plurality of first inductive sensors 422 are arranged vertically on the second fixing plate 421, and the emitting ends of the plurality of first inductive sensors 412 and the emitting ends of the plurality of second inductive sensors 422 are in the same vertical plane, ensuring that a tennis ball can be detected by the first inductive sensors 412 and the second inductive sensors 422 in the same vertical plane, reducing detection errors caused by position differences and improving accuracy of speed detection.

Wherein, the plurality of first inductive sensors 412 and the plurality of second inductive sensors 422 may be vertically distributed in a vertical direction, so that the emitting ends of the first inductive sensors 412 and the emitting ends of the second inductive sensors 422 are on a same vertical line, thereby forming a light curtain. When a tennis ball passes through the light curtain, the light curtain detects the tennis ball for a continuous time period $t_1$, and the first inductive sensors 412 and/or the second inductive sensors 422 transmit data indicative of the detected time period $t_1$ to the main control device 300 in which data indicative of a diameter $s_1$ of the tennis ball is stored. A speed of the tennis ball when passing through the light curtain, i.e., the serve speed $v_1$ of the tennis ball, is calculated by the main control device 300 according to the diameter $s_1$ of the tennis ball and the time period $t_1$ for the tennis ball to pass through the light curtain:

$$v_1 = \frac{s_1}{t_1}.$$

The light curtain through which the tennis ball passes may be formed by the first inductive sensors 412, the second inductive sensors 422, or the first inductive sensors 412 and the second inductive sensors 422, that is, the movement path of the tennis ball is unpredictable, resulting in inconsistent paths through the light curtain.

The plurality of first inductive sensors 412 and the plurality of second inductive sensors 422 may also be distributed in parallel in a same vertical plane, so that the emitting ends of the plurality of first inductive sensors 412 and the emission ends of the plurality of second inductive sensors 422 are distributed in parallel, thereby forming two light curtains. When a tennis ball contacts the two light curtains respectively, the first inductive sensors 412 transmit data indicative of a time point $t_2$ at which the tennis ball is detected to the main control device 300, and the second inductive sensors 422 transmit time data indicative of a time point $t_3$ at which the tennis ball is detected to the main control device 300. Meanwhile, distance data indicative of a distance $s_2$ between the first inductive sensors 412 and the second inductive sensors 422, that is, distance data indicative of a distance between the two light curtains, is stored in the main control device 300, so that a speed of the tennis ball when passing through the light curtains, that is, the serve speed $v_2$ of the tennis ball, is calculated by the main control device 300 according to the time data and the distance data:

$$v_2 = \frac{s_2}{|t_3 - t_2|}.$$

The device for measuring speed of a tennis ball can receive the serve speed information transmitted by the main control device 300 by arranging a terminal device, a loudspeaker or a display screen 130 and the like, so that the speed of the tennis ball can be known by a user.

A device for measuring speed of a tennis ball is further provided according to another embodiment of the disclosure, wherein the housing 100 is provided with a first vertical guide groove 110 and a second vertical guide groove 120 for guiding the second fixing plate 421 to slide vertically.

In this embodiment, the first vertical guide groove 110 and the second vertical guide groove 120 are arranged to facilitate vertical sliding of the second fixing plate 421 on the housing 100, so as to prevent the emitting ends of the first inductive sensors 412 and the second inductive sensors 422 from being not on the same vertical line due to position deviation of the second fixing plate 421 in the sliding process, thereby improving the accuracy of detection on the serve speed.

A device for measuring speed of a tennis ball is further provided according to another embodiment of the disclosure, wherein the transmission device 500 includes a motor 510, a transmission shaft 520, a gear 530, and a knob 540 for controlling operation of the motor 510. The transmission shaft 520 has a lower end connected to the motor 510 and an upper end connected to the gear 530. The gear 530 is engaged with a vertical side of the second fixing plate 421, the motor 510 is connected respectively to the main control device 300 and the power supply 200, the knob 540 is connected to the main control device 300 and provided on a surface of the housing 100.

In this embodiment, the lower end of the transmission shaft 520 is connected to the motor 510, so that the motor 510 can drive the transmission shaft 520 to rotate, and the upper end of the transmission shaft 520 is connected to the gear 530, so that the motor 510 can drive the gear 530 to rotate. The gear 530 is engaged with the vertical side of the second fixing plate 421, so that the motor 510 can drive the second fixing plate 421 to move in the vertical direction, which enables the second inductive sensors 422 and the first inductive sensors 412 to be distributed vertically in the vertical direction, realizing that the emitting ends of the first inductive sensors 412 and the emitting ends of the second inductive sensors 422 are on the same vertical line to form a light curtain for measuring the serve speed of the tennis ball. The knob 540 is configured for controlling operation of the motor 510, rotation of the knob 540 in a direction can drive the motor to rotate in a direction, and operating time of the motor 510 can be adjusted by controlling a rotation degree of the knob 540. The main control device 300 is connected to the knob 540 and the motor 510 respectively. When the knob 540 rotates, it sends a first trigger signal to the main control device 300. The main control device 300 outputs a first drive signal to the motor 510 based on the first trigger signal, and the motor 510 receives the first drive signal and rotates accordingly. The driving between the knob 540 and the motor 510 is provided in a simple way, which is convenient for operation and thus reduces the difficulty in use.

Figure 4:
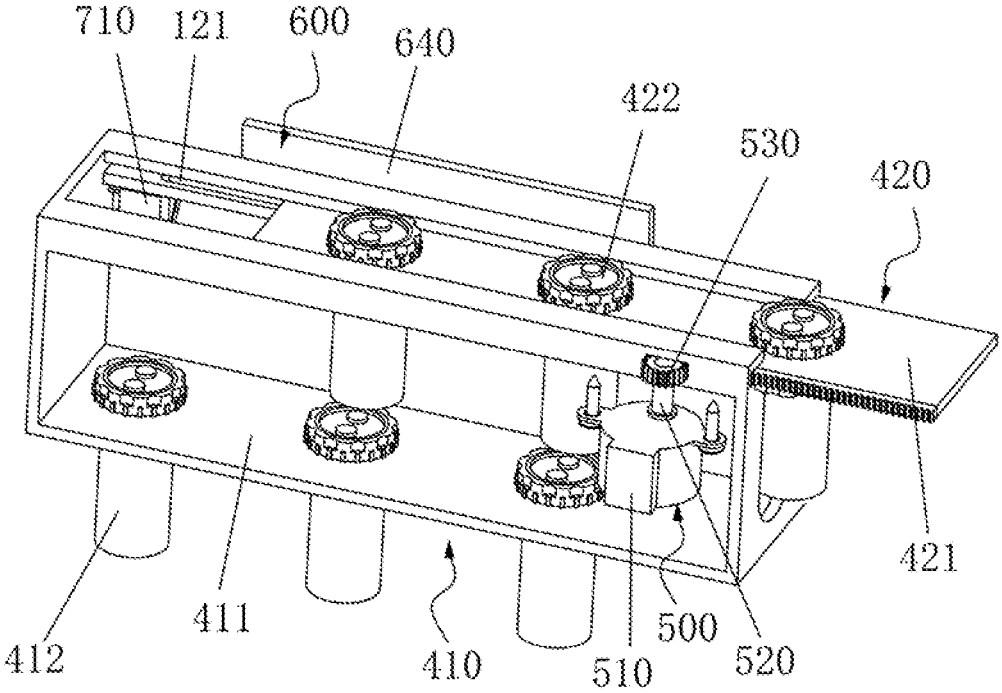
FIG. 4 is a structural view of a sensor device according to an embodiment of the disclosure.

With reference to FIG. 4, a device for measuring speed of a tennis ball is further provided according to another embodiment of the disclosure, wherein the second fixing plate 421 is provided with a limiting block 4211, and the second vertical guide groove 120 is provided with a first elongated slot 121, to which the limiting block 4211 is slidably connected, for limiting a sliding distance of the limiting block 4211.

In this embodiment, the second fixing plate 421 is provided with the limiting block 4211 on a surface contacting the second vertical guide groove 120, the second vertical guide groove 120 is provided with the first elongated slot 121 at a corresponding position where the limiting block 4211 slides, the limiting block 4211 is slidably connected in the first elongated slot 121, and the arrangement of the first elongated slot 121 effectively limits a sliding distance of the limiting block 4211, so that the second fixing plate 421 is slidably connected with the second vertical guide groove 120 within a limited range to prevent the second fixing plate 421 from falling off due to excessive sliding, effectively protecting the second fixing plate 421, and reducing the difficulty of detection.

Figure 5:
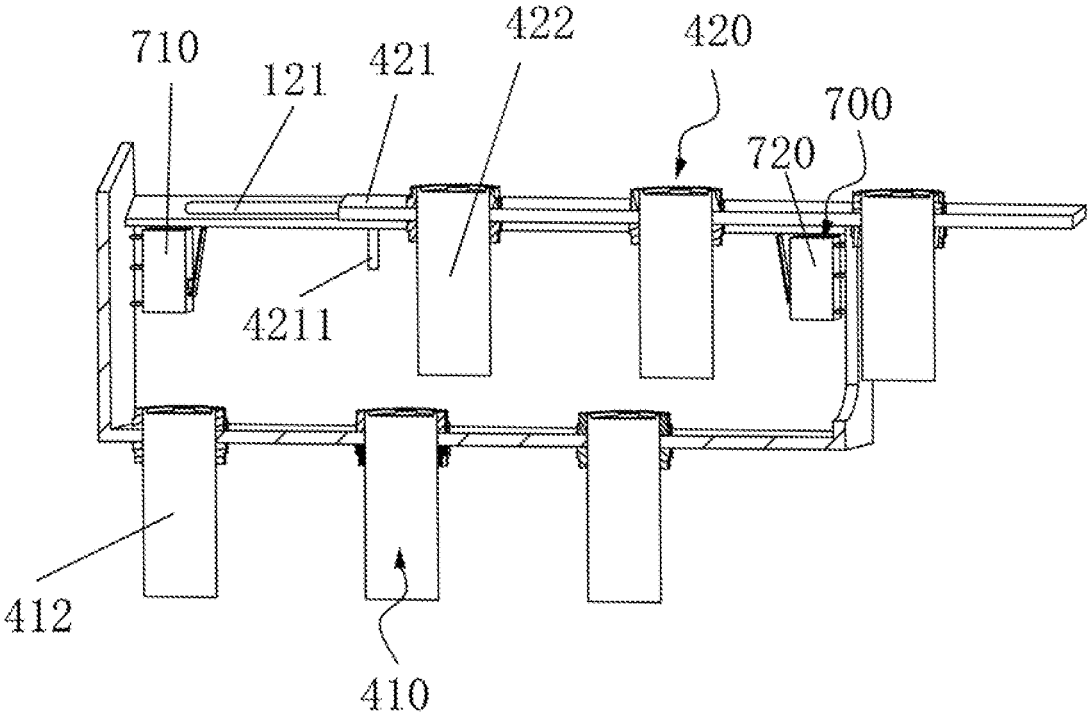
FIG. 5 is a cross-sectional view of the sensor device according to an embodiment of the invention.

With reference to FIG. 5, a device for measuring speed of a tennis ball is further provided according to another embodiment of the disclosure, wherein the limiting device 700 includes a first limiting switch 710 at a top end of the first elongated slot 121 and a second limiting switch 720 at a bottom end of the first elongated slot 121. The limiting block 4211 is connected to the first limiting switch 710 or the second limiting switch 720 to limit excessive operation of the transmission device 500.

In this embodiment, the first limiting switch 710 and the second limiting switch 720 are of a contact type, including a stop for controlling a circuit. The first limiting switch 710 is arranged at the top end of the first elongated slot 121 and the second limiting switch 720 is arranged at the bottom end of the first elongated slot 121. Since the limiting block 4211 is connected cooperatively with the first elongated slot 121, the second fixing plate 421 drives the limiting block 4211 to move in the first elongated slot 121 when the transmission device 500 drives the second fixing plate 421 to move, and the first elongated slot 121 limits a sliding distance of the limiting block 4211. When the limiting block 4211 moves to the top end of the first elongated slot 121, the limiting block 4211 contacts with the stop of the first limiting switch 710 causing a change in the circuit of the first limiting switch 710, the first limiting switch 710 generates a second trigger signal and transmits the second trigger signal to the main control device 300, the main control device 300 outputs a second drive signal to the transmission device 500 based on the second trigger signal, and the transmission device 500 receives the second drive signal and stops operating. When the limiting block 4211 moves to the bottom end of the first elongated slot 121, the limiting block 4211 contacts with the stop of the second limiting switch 720 causing a change in the circuit of the second limiting switch 720, the second limiting switch 720 generates a third trigger signal and transmits the third trigger signal to the main control device 300, the main control device 300 outputs a third drive signal to the transmission device 500 based on the third trigger signal, and the transmission device 500 receives the third drive signal and stops operating. The arrangement of the first limiting switch 710 and the second limiting switch 720 can effectively limit excessive operation of the transmission device 500, preventing the gear 530, the engaged side or the limiting block 4211 of the second fixing plate 421 from being damaged due to excessive operation of the transmission device 500. The change in the circuits of the first limit switch 710 and the second limit switch 720 may be switching off or on the circuit so as to change the current in the circuit.

Figure 2:
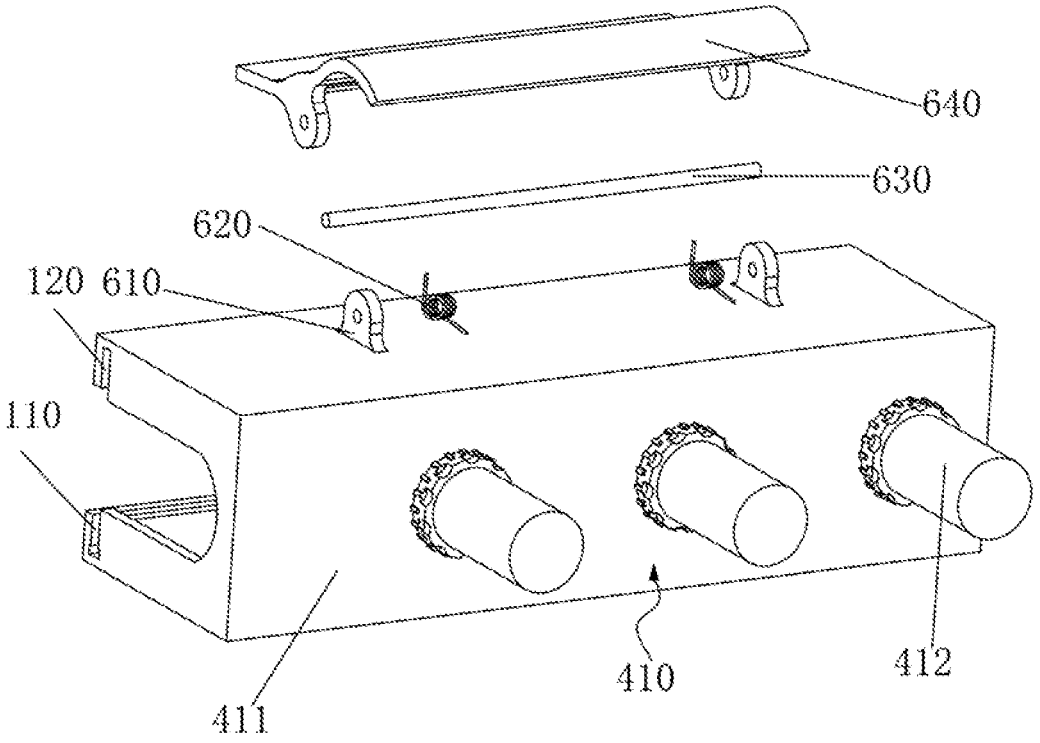
FIG. 2 is a structural view of a clamping device according to an embodiment of the disclosure.

With reference to FIG. 2, a device for measuring speed of a tennis ball is further provided according to another embodiment of the disclosure, wherein the clamping device 600 includes: a lug 610, a torsion spring 620, a pin 630 and a clip 640. The housing 100 is connected to the lug 610, and the clip 640 is hinged to the lug 610 via the torsion spring 620 and the pin 630.

In this embodiment, the clip 640 is hinged to the lug 610 through the torsion spring 620 and the pin 630, and the lug 610 is connected to the housing 100. The clip 640 is configured for clamping a tennis ball machine at a serve opening of the tennis ball machine, so that the device for measuring speed of a tennis ball can accurately measure the serve speed of a tennis ball. The structure is simple and the operation is convenient.

A device for measuring speed of a tennis ball is further provided according to another embodiment of the disclosure, wherein the second inductive sensors 422 are infrared sensor 4221 or ultrasonic sensors 4222.

In this embodiment, the infrared sensor 4221 is a sensor that uses the physical properties of infrared rays to perform measurement. Infrared, also known as infrared light, has the properties of reflection, refraction, scattering, interference, absorption, etc. Any substance can radiate infrared as long as it has a certain temperature (above absolute zero). Therefore, the infrared emitted by a plurality of infrared sensors 4221 constitutes an infrared light curtain. The infrared light curtain can effectively detect a tennis ball with a fast measurement speed and high sensitivity, thereby improving the accuracy of detection on the serve speed.

The ultrasonic sensor 4222 is a sensor developed using the properties of ultrasonic waves. Ultrasound waves, as mechanical waves with a vibration frequency higher than that of acoustic waves, is generated by the vibration of a transducing wafer under the excitation of a voltage, which has the properties of high frequency, short wavelength, good directivity, and can be rays for directional propagation. The ultrasonic waves have great penetrating power to liquids and solids, especially for opaque solids, significant reflections can be generated to form echoes. Therefore, the ultrasonic sensor 4222 can effectively detect a tennis ball accurately with high sensitivity. Meanwhile, the first inductive sensors 412 may also be infrared sensors or ultrasonic sensors 4222.

A device for measuring speed of a tennis ball is further provided according to another embodiment of the disclosure, wherein the housing 100 is provided with a display screen 130 on a surface of the housing 100, which is connected respectively with the power supply 200 and the main control device 300.

In this embodiment, the display screen 130 is configured for receiving serve speed information transmitted by the main control device 300, and the display screen 130 displays a serve speed of a tennis ball according to the serve speed information. The display screen 130 is arranged on the surface of the housing 100, so that a user can conveniently obtain the serve speed of the tennis ball, which brings more professional training for a tennis player.

In addition, with reference to FIG. 1-5, a device for measuring speed of a tennis ball is further provided according to another embodiment of the disclosure, including a housing 100, a power supply 200, a main control device 300, a first fixing plate 411 and a plurality of first infrared sensors 412 vertically arranged on the first fixing plate 411, a second fixing plate 421 and a plurality of second infrared sensors 422 vertically arranged on the second fixing plate 4221, a motor 510, a transmission shaft 520, a gear 530, and a knob 540 for controlling operation of the motor 510, a lug 610, a torsion spring 620, a pin 630 and a clip 640, a first limiting switch 710 and a second limiting switch 720. The housing 100 is provided with a first vertical guide groove 110 and a second vertical guide groove 120 for guiding the second fixing plate 421 to slide vertically. The second fixing plate 421 is provided with a limiting block 4211, and the second vertical guide groove 120 is provided with a first elongated slot 121 for limiting a sliding distance of the limiting block 4211. The housing 100 is provided with a display screen 130 and a knob 540 on a surface of the housing 100. The transmission shaft 520 has a lower end connected to the motor 510 and an upper end connected to the gear 530. The gear 530 is engaged with a vertical side of the second fixing plate 421. The limiting block 4211 is slidably connected to the first elongated slot 121. The clip 640 is hinged to the lug 610 via the torsion spring 620 and the pin 630. The first limiting switch 710 is arranged at a top end of the first elongated slot 121 and the second limiting switch 720 is arranged at a bottom end of the first elongated slot 121. The limiting block 4211 is connected to the first limiting switch 710 or the second limiting switch 720 to limit excessive operation of the motor 510. Emitting ends of the plurality of first infrared sensors 412 and emitting ends of the plurality of second infrared sensors 4221 are in a same vertical plane. The second fixing plate 421 is slidably connected with the housing 100.

The housing 100 is connected respectively with the power supply 200, the main control device 300, the first fixing plate 411, the first infrared sensors 412, the second fixing plate 421, the second infrared sensors 4221, the motor 510, the gear 530, the knob 540, the lug 610, the torsion spring 620, the first limiting switch 710 and the second limiting switch 720. The power supply 200 is connected respectively with the main control device 300, the first infrared sensors 412, the second infrared sensors 4221, the motor 510, the knob 540, the first limiting switch 710 and the second limiting switch 720. The main control device 300 is connected respectively with the first infrared sensors 412, the second infrared sensors 4221, the motor 510, the knob 540, the first limiting switch 710 and the second limiting switch 720.

In this embodiment, the clip 640 clamps at a serve opening of a tennis ball machine, so that the device for measuring speed of a tennis ball can be fixed at the serve opening of the tennis ball machine to accurately measure the serve speed of a tennis ball with simple operation. The housing 100 is slidably connected with the second fixing plate 421, the gear 530 is engaged with the second fixing plate 421, the motor 510 drives the gear 530 to rotate so that the second fixing plate 421 has a telescopic function to bring the plurality of the second infrared sensors 4221 to move, which increases the detection range for tennis balls, reduces the volume of the device for measuring speed of a tennis ball so that it is convenient for moving and carrying. Connection of the limiting block 4211 to the first limiting switch 710 or the second limiting switch 720 can effectively limit excessive operation of the motor 510, preventing the gear 530, the engaged side or the limiting block 4211 of the second fixing plate 421 from being damaged due to excessive operation of the motor 510.

The emitting ends of the first infrared sensors 412 and the emitting ends of the second infrared sensors 4221 are on a same vertical line, thereby forming a light curtain. When a tennis ball passes through the light curtain, the light curtain detects the tennis ball for a continuous time period, and the first infrared sensors 412 and/or the second infrared sensors 4221 transmit the detected time period to the main control device 300 in which a diameter of the tennis ball is stored. A speed of the tennis ball when passing through the light curtain, i.e., the serve speed of the tennis ball, is calculated by the main control device 300 according to the diameter of the tennis ball and the time period for the tennis ball to pass through the light curtain. Arrangement of the light curtain in the vertical direction reduces detection errors caused by position differences and improves accuracy of speed detection.

While the preferred embodiments of the disclosure have been described, the disclosure is not limited to the above embodiments, and those skilled in the art can make various equivalent modifications or substitutions without departing from the principle of the disclosure, and such equivalent modifications or substitutions are to be included within the scope of the disclosure defined by the claims.

We claim:

1. A device for measuring speed of a tennis ball, comprising:

a housing, a power supply, a main control device, a sensor device, a transmission device, a clamping device and a limiting device for limiting excessive operation of the transmission device; wherein the sensor device comprises a first sensor device and a second sensor device;

the transmission device is engaged with the second sensor device to drive the second sensor device so that an emitting end of the second sensor device and an emitting end of the first sensor device are in a same vertical plane;

the limiting device is connected to the second sensor device to limit excessive operation of the transmission device;

the housing is connected respectively to the power supply, the main control device, the first sensor device, the transmission device, the limiting device and the clamping device, and is slidably connected with the second sensor device;

the power supply is connected to the main control device, the first sensor device, the second sensor device, the transmission device and the limiting device;

the main control device is connected respectively to the first sensor device, the second sensor device, the transmission device and the limiting device.

2. The device of claim 1, wherein the first sensor device comprises: a first fixing plate and a plurality of first inductive sensors vertically arranged on the first fixing plate, the second sensor device comprises: a second fixing plate and a plurality of second inductive sensors vertically arranged on the second fixing plate, and emitting ends of the plurality of first inductive sensors and emitting ends of plurality of second inductive sensors are in a same vertical plane;

the power supply is connected respectively with the first inductive sensors and the second inductive sensors, the main control device is connected respectively with the first inductive sensors and the second inductive sensors, and the second fixing plate is connected respectively with the transmission device and the limiting device, the second fixing plate is slidably connected with the housing and is engaged with the transmission device.

3. The device of claim 2, wherein the housing is provided with a first vertical guide groove and a second vertical guide groove for guiding the second fixing plate to slide vertically.

4. The device of claim 2, wherein the transmission device comprises a motor, a transmission shaft, a gear, and a knob for controlling operation of the motor;

the transmission shaft has a lower end connected to the motor and an upper end connected to the gear;

the gear is engaged with a vertical side of the second fixing plate, the motor is connected respectively to the main control device and the power supply, the knob is connected to the main control device and provided on a surface of the housing.

5. The device of claim 3, wherein the second fixing plate is provided with a limiting block, and the second vertical guide groove is provided with a first elongated slot, to which the limiting block is slidably connected, for limiting a sliding distance of the limiting block.

6. The device of claim 5, wherein the limiting device comprises a first limiting switch at a top end of the first elongated slot and a second limiting switch at a bottom end of the first elongated slot;

the limiting block is connected to the first limiting switch or the second limiting switch to limit excessive operation of the transmission device.

7. The device of claim 1, wherein the clamping device comprises: a lug, a torsion spring, a pin and a clip;

the housing is connected to the lug, and the clip is hinged to the lug via the torsion spring and the pin.

8. The device of claim 1, wherein the second inductive sensor is infrared sensor or ultrasonic sensor.

9. The device of claim 1, wherein the housing is provided with a display screen on a surface of the housing, which is connected respectively with the power supply and the main control device.

* * * * *